United States Patent [19]

Eckstrom

[11] Patent Number: 4,651,443

[45] Date of Patent: Mar. 24, 1987

[54] WELTING FOR A SHOE

[75] Inventor: Delano Eckstrom, Red Wing, Minn.

[73] Assignee: Red Wing Shoe Company, Inc., Minneapolis, Minn.

[21] Appl. No.: 800,997

[22] Filed: Nov. 22, 1985

[51] Int. Cl.[4] ..... A43B 15/00

[52] U.S. Cl. ..... 36/17 R; 36/78; D2/328

[58] Field of Search ..... 36/17 R, 78, 17 PW, 36/17 A; 12/142 D, 142 T, 146 W; D2/326, 328

[56] References Cited

U.S. PATENT DOCUMENTS

| | | | |
|---|---|---|---|
| D. 141,974 | 8/1945 | Wright | D2/328 |
| D. 163,559 | 6/1951 | Batchelder, Jr. | D2/328 |
| 1,059,698 | 4/1913 | Arnold | 12/146 W |
| 1,632,768 | 6/1927 | Dullnsky | 36/78 |
| 2,098,911 | 11/1937 | Brown | 36/78 |
| 2,299,831 | 10/1942 | Lyon | 36/17 R |
| 2,438,095 | 3/1948 | Phinney | 36/78 |
| 2,448,165 | 8/1948 | Wright | 36/78 |
| 2,563,638 | 8/1951 | Batchelder et al. | 36/78 |
| 2,753,636 | 7/1956 | Withington | 36/78 |
| 3,064,368 | 11/1962 | Daniels | 36/78 |
| 3,113,388 | 12/1963 | Rubico | 36/78 |
| 3,170,253 | 2/1965 | Johnson | 36/78 |
| 4,236,327 | 12/1980 | Gorsche et al. | 36/17 R |
| 4,450,632 | 5/1984 | Bensley | 36/17 PW |

FOREIGN PATENT DOCUMENTS

| | | | |
|---|---|---|---|
| 1030028 | 6/1953 | France | 36/17 R |

*Primary Examiner*—Werner H. Schroeder
*Assistant Examiner*—Steven N. Meyers
*Attorney, Agent, or Firm*—Merchant, Gould, Smith, Edell, Welter & Schmidt

[57] ABSTRACT

A welt is disclosed for shoes having outer soles formed by means of a foaming process. The welt includes a substantially horizontal outsole attaching member having a bottom surface for joining to a shoe outsole. An inseam portion is provided integral with the outsole attaching member along an inner end of the outsole attaching member. A stitch receiving groove is defined by opposing surfaces of the inseam attaching portion and the bottom surface of the outsole attaching member. A hook portion is integral with the outsole attaching member and extends vertically downwardly from the bottom surface along the inner end with the hook portion defining a foam receiving groove beneath the bottom surface.

8 Claims, 5 Drawing Figures

FIG. 5
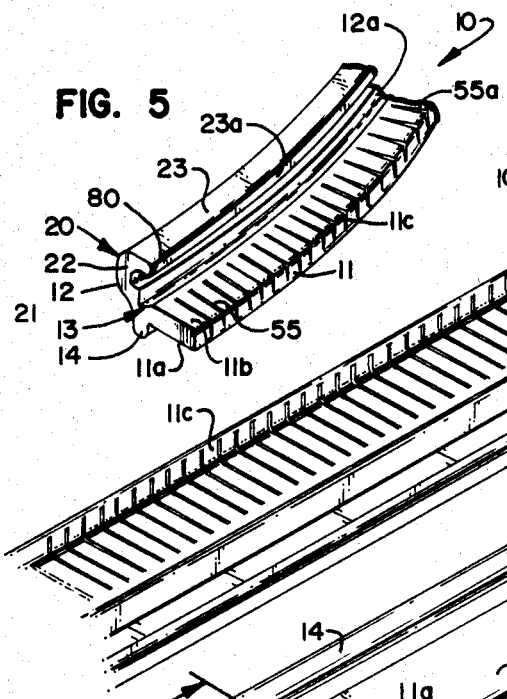
FIG. 1
FIG. 2
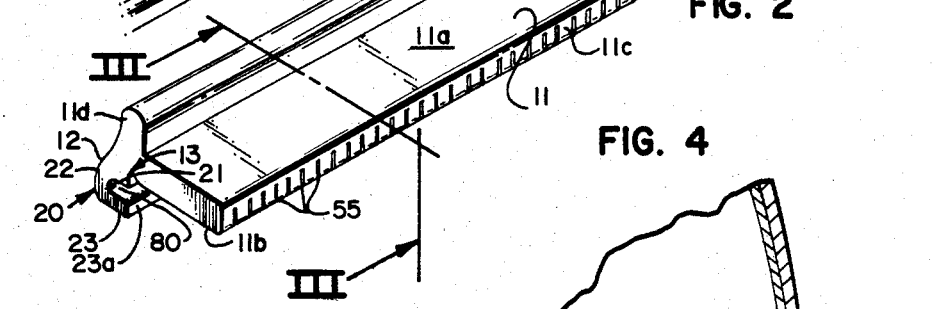
FIG. 3
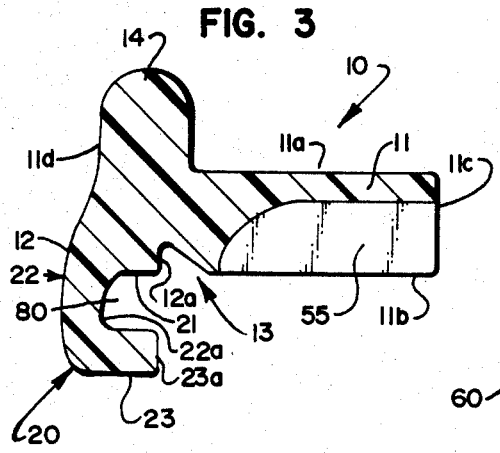
FIG. 4
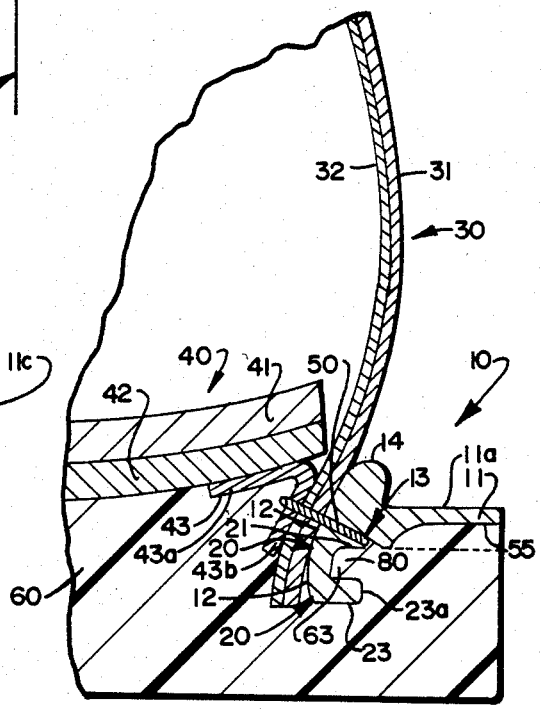

WELTING FOR A SHOE

BACKGROUND OF THE INVENTION

I. Field of the Invention

This invention pertains to welts for shoes and more particularly to welts for shoes having soles made from urethane foam.

II. Description of the Prior Art

In the prior art, welts have been extensively used in shoe manufacture to cover a seam formed between a shoe outer sole and a shoe upper. Such welts are provided with upstanding beads at their inner end which are deformed by the shoe upper such that the shoe upper and beads are close fitting thereby covering the seam and also providing an obstacle against water attempting to migrate to the stitching of the shoe. The welt is bonded to the shoe sole and to the upper of the shoe to strengthen the joint.

Prior art shoe welts are shown in the following U.S. Pat. Nos.: 2,438,095; 2,753,636; 3,113,388; 2,563,638; and 2,448,165. Such prior art shoe welts have several features in common. First, the welts have a horizontal body portion to be bonded to an upper surface of a shoe outer sole along the shoe upper. Commonly, such welts are provided with upstanding beads along an inner edge of the body portion with the bead abutting the surface of the shoe upper. Such prior art welts further include stitch receiving grooves along the bottom of the body portion near the inner edge. The stitch receiving grooves accommodate stitching which secures the welt to the shoe upper and to the shoe insole.

While some of the aforementioned patents show shoe welts having portions extending vertically downwardly from the inner end of the body portion, these portions are typically trimmed before the shoe welt is secured to the shoe outer sole. Typically, the shoe welt is secured to the outer sole by stitching.

The aforementioned U.S. patents are applicable to shoes having leather outsoles where the shoe welt may be readily stitched to the outsole. Today, the shoe manufacturing art includes not only leather shoe soles but also shoe soles which are formed from hardened urethane foam. In such shoes, the shoe welt is not stitched to the shoe sole but is attached to the urethane foam by adhesion as the foam hardens. However, a good bond between the sole and the welt is not always achieved. A possible explanation for the lack of a good bond may be the presence of air bubbles between the foam and the welt. In such cases, the welt may break away from the urethane sole after a period of use.

OBJECTS AND SUMMARY OF THE INVENTION

It is an object of the present invention to provide a welt for a shoe having a sole of hardened urethane foam.

A still further object of the present invention is to provide a welt for a foam-soled shoe where the welt has improved adhesion and connection to the shoe sole.

A yet further object of the present invention is to provide a shoe welt for a urethane foam sole where the welt is provided with means for anchoring the welt to the shoe sole.

According to a preferred embodiment of the present invention a shoe welt is disclosed for shoes having outer soles which are formed by a foaming process. The welt includes a generally horizontal outsole attaching member having an inseam attaching portion at an inner end of the outsole attaching member. A bottom surface of the outsole attaching member and an opposing surface of the inseam attaching portion define a stitch receiving groove for receiving a stitch to anchor the inseam attaching portion against a shoe upper. The shoe is provided with an upstanding bead at the inner end of the attaching member and above the inseam attaching portion. A hook portion is provided at the inner end of the horizontal member beneath the inseam attaching portion with the hook portion defining a foam receiving groove beneath the bottom surface of the outsole attaching member.

BRIEF DESCRIPTION OF THE DRAWINGS

FIG. 1 is a perspective view of a shoe welt according to the present invention as viewed from the bottom of the welt;

FIG. 2 is a perspective view of a shoe welt according to the present invention when viewed from the top of the welt;

FIG. 3 is a view taken in cross section of a welt according to the present invention taken along line III—III of FIG. 2;

FIG. 4 is a partial view taken in cross section of a shoe having a welt according to the present invention; and FIG. 5 is a perspective view of a shoe welt according to the present invention with the welt arcuately spread opening grooves therein.

DETAILED DESCRIPTON OF THE PREFERRED EMBODIMENT

Referring to the drawings, a shoe welt is shown generally at 10. The welt has a generally horizontal outsole attaching member 11 which is rectangular in cross section and is provided with an upper horizontal surface **11*a* and lower horizontal surface 11*b*. The shoe welt 10 has an outside end 11*c* and an inner end 11*d*. An inseam attaching portion 12 is provided integral with the outsole attaching member along the inner end 11*d*. The bottom surface 11*b* of the outsole attaching member and an opposing surface 12*a* of the inseam attaching portion define a stitch receiving groove 13. An upstanding bead 14 is provided at the inner end of the outsole attaching member and projects vertically upwardly above the upper surface 11*a*. The bottom surface 11*b* is provided with a plurality of generally parallel spaced apart slits 55 perpendicular to the outside end 11*c*. As shown in the Figures, the slits 55 cut through approximately two-thirds of the outsole attaching member 11 and cut through outside end 11*c***.

A hook portion, shown generally at 20, is provided integral with the outsole attaching member 11 at an inner end of the attaching member and projecting generally vertically downwardly from the inseam attaching portion 12. The hook portion 20 has an upper surface 21 which is generally parallel to and coplanar with the bottom surface **11*b* of the outsole attaching member. Additionally, the hook portion has a generally vertical portion 22 which has an outwardly facing vertical face 22*a* disposed inwardly of the vertical surface 12*a* defining the stitch receiving groove 13. An outwardly projecting flange 23 is provided at the bottom of the vertical portion 22 with flange 23 having a generally horizontal upper surface 23*a* having a width generally equal to surface 21 and with surface 23*a* and surface 21 being generally parallel in spaced apart alignment. Surfaces 21, 22***a* and 23*a* define a foam receiving groove 80 which is generally rectangular in cross section extending the entire length of the welt 10 along the inner end of the attaching member 11 and below the lower surface 11*b* of the attaching member 11.

Referring now to FIG. 4, a shoe is shown having a welt according to the present invention. The shoe consists of generally vertical shoe upper 30 which comprises an outer upper portion 31 and an inner upper portion 32. The shoe is also provided with an insole shown generally at 40 which comprises an upper insole portion 41 and a lower insole portion 42. A connecting strap is provided having a V-shaped configuration in cross section with a first edge 43*a* secured to the bottom insole through any suitable means and a second edge 43*b* secured to the inner upper by means of stitching 50. As shown in FIG. 4, the shoe is positioned with the welt 10 having its inseam attaching portion 12 and upstanding bead 14 abutting an outer surface of the outer shoe upper 31. The stitching 50 is received within the stitch receiving groove 13 and extends through the inner upper 32 and outer upper 31 and engages the second edge 43*a* of strap 43. Accordingly, stitching 50 effectively binds both the insole 40, upper 30 and welt 10. As the welt 10 is bent around the shoe toe, the slits 55 separate to permit the bend without the welt 10 tearing. As the welt 10 is bent, the slits 55 form V-shaped grooves 55*a*, shown best in FIG. 5.

The shoe outer sole 60 is bonded to the bottom insole 42 and shoe welt 10. The outsole 60 is formed of hardened urethane foam and is hardened in a mold adjacent the bottom insole 42 and welting 10. When the foam is injected into the mold, the foam material assumes the shape of the insole 42 and welt 10. Accordingly, the foam material fills the slits 55 and the V-shaped grooves 55*a* formed on the bottom surface 11b of the welt 10 and also fills the foam receiving notch defined by the opposing surfaces of the hook portion 20 of welt 10. As the foam hardens, the foam adheres to the bottom insole and the surface of the welt 10. Additionally, the foam within the foam receiving groove 80 forms a foam anchor 63 which extends around the entire length of the welt and provides mechanical support joining the welt 10 to the sole 60 which is particularly strong in avoiding relative movement in a vertical direction between the welt 10 and sole 60. The slits 55 and V-shaped grooves 55*a* of the bottom surface 11*b* further add strength to the bond between the welt 10 and the sole 60 by providing increased surface area for increased adhesion between the bottom surface 11*b* and the sole 60. Also, the relative vertical surfaces between the welt 10 and foam within the slits 55 and V-shaped grooves 55*a* provide mechanical support resisting relative lateral movement between the welt 10 and foam 60.

From the foregoing, it can be seen that the objects of the present invention have been achieved in a preferred manner. While the foregoing is a preferred embodiment of the present invention, the particular embodiment shown should not be construed as being a limitation of the present invention and the present invention is intended to include modifications of this embodiment and equivalents thereof which would be apparent to those skilled in the art. The scope of the invention is intended to be limited only by the scope of the claims which are appended hereto.

What is claimed is:

1. A welt for shoes having outer soles formed by means of a foaming process; said welt comprising:

a substantially horizontal outsole attaching member having a bottom surface for joining to a shoe outsole;

an inseam attaching portion integral with said outsole attaching member along an inner end thereof;

a stitch receiving groove defined by opposing surfaces of said inseam attaching portion and said bottom surface;

a hook portion integral with said outsole attaching member defining a foam receiving groove beneath said bottom surface along said inner end, with said hook portion having a generally horizontal upper surface at said inner end of said outsole attaching member; a generally vertical portion extending downwardly from said inseam attaching portion; an outwardly extending flange projecting from said vertical portion with said upper surface and opposing surfaces of said vertical portion and flange defining said foam receiving groove.

2. A welt according to claim 1 wherein said hook portion is disposed with said groove defining a generally rectangular cross section groove having a vertical opening and disposed beneath said stitch receiving groove.

3. A welt according to claim 2 wherein said upper surface of said hook is generally parallel with said bottom surface of said outsole attaching portion.

4. A welt according to claim 2 wherein said bottom surface of said outsole attaching portion is provided with a plurality of slits projecting from an outside end of said outsole attaching member toward said inner end with said slits cut partially through said outsole attaching member.

5. A shoe having an outer sole formed by means of a foaming process; said shoe comprising:

an insole;

a shoe upper;

a shoe welt having a generally horizontal outsole attaching member, a bottom surface and an integral inseam attaching portion along an inner end of said outsole attaching member with said inner end abutting an outer surface of said shoe upper; means connecting said inseam attaching member to said upper and said insole; a hook portion integral with said outsole attaching member and extending away from said bottom surface along said inner end and defining a foam receiving groove beneath said bottom surface, said hook portion comprises an upper surface at said inner end of said outsole attaching member; a generally vertical portion extending downwardly from said inseam attaching portion; an outwardly extending flange projecting from said vertical portion with said upper surface and opposing surface of said vertical portion and flange defining said groove;

an outsole formed by a foaming process and secured to said insole and said bottom surface of said outsole attaching member with said outsole having an integral anchor formed within said foam receiving groove with said anchor substantially filling said groove.

6. A shoe according to claim 5 wherein said connecting means includes a stitch receiving notch defined by opposing surfaces of said bottom surface and said inseam attaching portion; a stitch received within said notch connecting said welt, upper and insole.

7. A shoe according to claim 6 wherein said hook is sized to present said groove beneath said notch with said groove having a substantially horizontal bottom surface.

8. A shoe according to claim 5 wherein said bottom surface of said outsole attaching portion is provided with a plurality of slits projecting from an outside end of said outsole attaching member toward said inner end with said slits cut partially through said outsole attaching member with said outshoe formed with outshoe material filling said slits.

* * * * *